US009502751B2

(12) United States Patent
Bayram et al.

(10) Patent No.: US 9,502,751 B2
(45) Date of Patent: Nov. 22, 2016

(54) DESENSITIZED ANTENNA AND DESIGN METHOD THEREOF

(71) Applicant: PaneraTech, Inc., Chantilly, VA (US)

(72) Inventors: Yakup Bayram, Falls Church, VA (US); Wladimiro Villarroel, Lewis Center, OH (US); Eric Walton, Columbus, OH (US)

(73) Assignee: PANERATECH, INC., Chantilly, VA (US)

( * ) Notice: Subject to any disclaimer, the term of this patent is extended or adjusted under 35 U.S.C. 154(b) by 331 days.

(21) Appl. No.: 14/474,422

(22) Filed: Sep. 2, 2014

(65) Prior Publication Data

US 2015/0061961 A1 Mar. 5, 2015

Related U.S. Application Data

(60) Provisional application No. 61/872,898, filed on Sep. 3, 2013.

(51) Int. Cl.

| | |
|---|---|
| ***H01Q 5/00*** | (2015.01) |
| ***H01Q 1/24*** | (2006.01) |
| ***H01Q 1/48*** | (2006.01) |
| ***H01Q 1/52*** | (2006.01) |
| ***H01Q 9/38*** | (2006.01) |
| ***H01Q 9/40*** | (2006.01) |

(52) U.S. Cl.

CPC ..... *H01Q 1/243* (2013.01); *H01Q 1/48* (2013.01); *H01Q 1/52* (2013.01); *H01Q 9/38* (2013.01); *H01Q 9/40* (2013.01)

(58) Field of Classification Search

CPC ..... H01Q 5/0041
USPC ..... 343/862
See application file for complete search history.

(56) References Cited

U.S. PATENT DOCUMENTS

| | | | |
|---|---|---|---|
| 5,872,542 | A | 2/1999 | Simons et al. |
| 6,384,790 | B2 | 5/2002 | Dishart et al. |
| 7,205,947 | B2 | 4/2007 | Parsche |
| 7,233,296 | B2 | 6/2007 | Song et al. |

(Continued)

FOREIGN PATENT DOCUMENTS

| | | |
|---|---|---|
| WO | WO 2005/086277 | 9/2005 |
| WO | WO 2013/149514 | 10/2013 |

*Primary Examiner* — Dameon E Levi
*Assistant Examiner* — Andrea Lindgren Baltzell
(74) *Attorney, Agent, or Firm* — Whiteford, Taylor & Preston LLP; Gregory M. Stone

(57) ABSTRACT

Disclosed is an antenna system and method to design a desensitized antenna element. The system and method are operative to design a configuration of an antenna to overcome a number of operational conditions in which the frequency response of the antenna element may be uniquely or significantly detuned or offset or in which undesired noise, signal interference, or electromagnetic coupling effects may affect or be induced by the antenna element. These operational conditions may include the presence of any combination of user body parts, conductive materials, or dielectric materials as well as neighboring electronic systems or other sources of undesired noise, signal interference, and electromagnetic coupling. The system is designed to mitigate adverse effects, when operating in a potentially antenna-detuning environment or under conditions that may affect other systems or be susceptible to being affected by other sources, by using a desensitizer element comprising at least one electrical circuit component.

20 Claims, 5 Drawing Sheets

(56) References Cited

U.S. PATENT DOCUMENTS

| | | | |
|---|---|---|---|
| 7,427,961 | B2 | 9/2008 | Song et al. |
| 7,675,466 | B2 | 3/2010 | Gaucher et al. |
| 7,983,721 | B2 | 7/2011 | Ying et al. |
| 8,279,131 | B2 | 10/2012 | Puzella et al. |
| 8,299,967 | B2 | 10/2012 | Xu et al. |
| 8,424,769 | B2 | 4/2013 | Kato |
| 8,634,764 | B2 | 1/2014 | Cruz et al. |
| 8,749,438 | B2 | 6/2014 | Jenwatanavet et al. |
| 8,766,856 | B2 | 7/2014 | Hsieh et al. |
| 2002/0152606 | A1 | 10/2002 | Huang |
| 2006/0009251 | A1 | 1/2006 | Noda et al. |
| 2007/0040746 | A1 | 2/2007 | Song et al. |
| 2007/0287503 | A1 | 12/2007 | Ying et al. |
| 2009/0267839 | A1 | 10/2009 | Liao et al. |
| 2011/0156967 | A1 | 6/2011 | Oh et al. |
| 2011/0273382 | A1 | 11/2011 | Yoo et al. |
| 2012/0133597 | A1 | 5/2012 | Chen |
| 2012/0162032 | A1 | 6/2012 | Yang et al. |
| 2012/0230377 | A1* | 9/2012 | Jenwatanavet ..... H01Q 1/085 375/222 |
| 2012/0287066 | A1 | 11/2012 | Yang et al. |
| 2013/0059532 | A1 | 3/2013 | Mahanfar et al. |
| 2014/0139379 | A1 | 5/2014 | Bolin et al. |
| 2014/0176819 | A1 | 6/2014 | Yilmaz |

* cited by examiner

DESENSITIZED ANTENNA AND DESIGN METHOD THEREOF

CROSS REFERENCE TO RELATED APPLICATION

This application is based upon and claims priority from U.S. Provisional Patent Application Ser. No. 61/872,898 entitled "DESENSITIZED ANTENNA AND DESIGN METHOD THEREOF" filed with the U.S. Patent and Trademark Office on Sep. 3, 2013, by the inventors herein, the specification of which is incorporated herein by reference.

FIELD OF THE INVENTION

The present invention relates to antenna systems and methods. More particularly, the present invention relates to antenna systems and to antenna design and manufacturing methods for overcoming adverse effects caused by spurious signals and antenna detuning

BACKGROUND OF THE INVENTION

A number of antenna designs and systems exist within various industries for enabling operation of a single antenna at several frequency bands for multiple applications. The antenna system configuration is the key factor that determines the number and location of such frequency bands. In general, a multiband antenna experiences a frequency detuning or offset when operating under conditions subject to the presence of extraneous materials that may electromagnetically couple to the antenna. Both electrically conductive and dielectric materials may significantly detune the antenna to render it inoperative at certain frequencies of interest.

This situation becomes more critical for antenna applications used in portable and handheld electronic devices, which may be affected by the presence of any combination of user body parts (e.g., hands, fingers, head or other parts of the body as when such device is placed in a pocket or hung on clothing), conductive materials, or dielectric materials located within a radius of two wavelengths at the lowest frequency of operation in the medium where the antenna element is operating. As a result, in certain applications, a multiband antenna designed for the specific frequency bands of the intended applications cannot be used.

In recent years, the demand for multiband antennas has increasingly grown for applications in the touchscreen, mobile platform, and automobile industries. In particular, the implementation of multiband antennas have been addressed in the prior art, as described in U.S. Pat. No. 8,749,438 to Jenwatanawet et al., the specification of which is incorporated herein by reference in its entirety. However, these efforts have faced certain challenges and limitations. Particularly, attempts made to provide robust single-antenna designs to withstand antenna detuning and at the same time capable of effectively and efficiently complying with signal integrity standards set up by industry have not been successful. A major challenge is that antennas are susceptible to being detuned by the presence of extraneous materials unless the antenna is enclosed in a separate module, making it bigger and more expensive. Likewise, multiple antenna elements are used to be able to operate at different frequency bands, which make the size requirements significantly larger and the need to use a larger number of or more complex electronic components.

As a result, a compromise is required between two conflicting goals. Firstly, making the antenna system robust enough to prevent detuning, which typically involves an antenna with wider frequency bandwidth than the minimum required; and secondly, making the antenna less susceptible to undesired noise, signal interference, or electromagnetic coupling effects that may affect or be induced by the antenna element, which means using an antenna with as minimum frequency bandwidth as possible.

Alternatively, an antenna design having a frequency band of operation that is larger than the required bandwidth that includes the different frequency bands of the intended applications may overcome frequency detuning. In other words, a wideband antenna that is detuned may still operate at the frequencies of interest. However, this requires the antenna to operate at frequencies of no operational interest, which may result in undesired noise, signal interference, or electromagnetic coupling effects that may affect or be induced by the antenna element.

Accordingly, manufacturers intending to use antennas for multiple applications in significantly constrained operational conditions experience either an unacceptable system sensitivity to detuning or an unacceptable system performance that does not meet signal integrity requirements. This leads manufacturers to implementation of antenna systems that are costly, aesthetically unappealing, or more importantly, highly inefficient by using adaptively tuned antenna elements, multiple antenna elements in a diversity configuration, or automatic mechanisms to increase the power transmitted by the antenna system.

Previous efforts have been made to develop wideband antenna elements for multiple applications, as described in U.S. Pat. No. 8,766,856 to Hsieh, et al., the specification of which is incorporated herein by reference in its entirety. However, these efforts typically result in using an antenna operating at significant frequency ranges of no operational interest for the intended applications. This faces severe challenges and limitations. While the approach of using a wideband antenna is effective in reducing or preventing significant antenna detuning, a major limitation may result where the system receives spurious signals from other sources that increase the noise level of the system. Another limitation may result where the antenna system radiates spurious signals that may interfere with other internal and external electronic systems. These limitations may compromise the signal integrity of internal and/or external systems or make it very challenging for a wideband antenna to meet signal integrity industry standards. As a result, this approach is not able to effectively prevent antenna detuning under operational conditions. Thus, even though the robustness of the antenna is improved, the signal integrity limitations may result in an overall antenna system performance that is unacceptable to meet industry standards.

A way to address the disadvantages of the efforts attempted by the prior art is to design a desensitized antenna system that integrates a desensitizer element with an antenna element. This would make it possible to increase the robustness of the overall antenna system while mitigating or eliminating undesired effects, by configuring the desensitizer element to constrain the operation of the antenna system at frequencies of no operational interest. In particular, a configuration may be designed to integrate an antenna and desensitizer element with a feeding mechanism and the corresponding transmission line in a single unit for additional advantages.

Currently, there is no well-established method of deterministically creating a desensitized antenna system that adapts to the frequency bands of operation, prevents undesired transmission and reception at frequencies of no operational interest, and effectively withstands frequency detuning under operational conditions.

Thus, there remains a need in the art for antenna systems and methods to desensitize antennas that are capable of a robust operation at the frequencies of intended applications, while avoiding the problems of prior art systems and methods.

SUMMARY OF THE INVENTION

A desensitized antenna system and method to design a desensitized antenna element is disclosed herein. One or more aspects of exemplary embodiments provide advantages while avoiding disadvantages of the prior art. The system and method are operative to provide a configuration of an antenna to overcome a number of operational conditions in which the frequency response of the antenna element may be uniquely or significantly detuned or offset or in which undesired noise, signal interference, or electromagnetic coupling effects may affect or be induced by the antenna element. These operational conditions may include the presence of any combination of user body parts, conductive materials, or dielectric materials as well as neighboring electronic systems or other sources of undesired noise, signal interference, and electromagnetic coupling. The system is designed to mitigate adverse effects, when operating in a potentially antenna-detuning environment or under conditions that may affect other systems or be susceptible to be affected by other sources, by using a desensitizer element comprising at least one electrical circuit component.

In general, an antenna may be detuned or offset in frequency under certain operational conditions, such as the presence of any combination of user body parts (e.g., hands, fingers, head or other parts of the body as when such device is placed in a pocket or hung on clothing), conductive materials, or dielectric materials located within a radius of two wavelengths at the lowest frequency of operation in the medium where the antenna element is operating.

A wideband antenna element may be allowed to overcome frequency detuning or offsets. Therefore, in certain situations, a wideband antenna element can perform as a desensitized antenna, depending on the required operational bandwidth and the amount of frequency detuning or offsets required to overcome under the expected operational conditions. For example, for a required operational bandwidth between 2.4 and 2.5 GHz, a wideband antenna element operating in the 2 to 6 GHz frequency band can perform as a desensitized antenna to overcome detuning or offsets of up to at least 3.5 GHz toward upper frequencies and detuning or offsets of up to at least 0.4 GHz toward lower frequencies. Likewise, by determining the amount and direction (upward or downward in frequency) of detuning or offsets for the different operational conditions, it is possible to design a desensitized antenna element, which remains operational under frequency detuning or offset conditions. Otherwise the detuning may degrade the signal integrity of the system or compromise its overall operation.

Common approaches to achieve an antenna system desensitization include using adaptively tuned antenna elements or multiple antenna elements in a diversity configuration. These solutions require external components that consume power and increase the size and cost of the antenna system. Other approaches include an automatic mechanism to increase the power transmitted by the antenna system causing an increase in power consumption and a reduced life of the electronic components.

Desensitizing an antenna element by means of designing an antenna to have a frequency band wider than the minimum required operational bandwidth inherently increases the overall noise of the antenna system. In addition, the antenna system becomes more susceptible to suffer from interference from external sources and to interfere with other systems. However, by designing the antenna system to comprise an antenna element in combination with a desensitizer element, such as a filter or other passive electronic components, it is possible to effectively and efficiently have higher signal integrity by mitigating adverse effects caused by noise signals and interference signals transmitted or received during the operation of the antenna system.

Therefore, to effectively implement a desensitized antenna system, it is critical to meet two requirements: first, to prevent frequency detuning during normal operation; and second, to minimize the susceptibility to the effects caused by RF noise, RF interference, and electromagnetic coupling in both transmit and receive modes of the antenna system. Furthermore, the integration of an antenna element, a desensitizer element, and a transmission line, including an appropriate feeding mechanism, allows efficient implementation of such desensitized antenna system in terms of cost, size, weight, power, and practical implications.

A desensitized antenna system designed according to the method described herein is able to meet these two requirements by adapting the frequency response of an antenna element to the actual frequency requirements of the intended applications with a frequency robust approach. In addition, this adaptation may take into consideration the input impedance matching between the antenna element and the transmission line feeding the antenna, which is also a key factor impacting the overall performance of the desensitized antenna system.

The determination of the configuration of the desensitized antenna system is based on a robust design of an antenna element and the integration of a desensitizer element to mitigate the transmission and reception of RF signals at undesired frequencies within the operational bandwidth of the antenna element. This results in a system operating primarily at the frequency bands of interest at a proper level of impedance matching.

The method to design a desensitized antenna system to mitigate adverse effects when operating in a potentially antenna-detuning environment or under conditions that may interfere with other systems or be susceptible to interference from other sources, and for setting up the antenna system dimensional and operational parameters includes the step of designing an antenna element having an operational frequency range that includes a minimum required system frequency band of operation, corresponding to an intended application.

The method further includes the steps of identifying the operational conditions in which the frequency response of the antenna element may be detuned or in which undesired noise, signal interference, or electromagnetic coupling effects may affect or be induced by the antenna element, and following one or more of several approaches to desensitize the antenna element. The method further includes the steps of reducing such undesired effects by designing a desensitizer element and integrating both the antenna and desensitizer elements, and selecting the desensitized antenna system configuration most suitable to be used for the intended application of the antenna system, in terms of performance or other predetermined criteria.

By significantly adapting the frequency response of an antenna element by means of integrating a desensitizer element with such antenna element, the desensitized antenna system and method are able to provide a robust design against frequency detuning, at the frequencies of intended operation, and a significant reduction of undesired effects at frequencies of no operational interest, as compared to designs using standard techniques. This results in antenna designs that meet or exceed challenging industry standards, in terms of antenna performance and signal integrity of both internal and external systems.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of one or more aspects of the invention, set out to enable one to practice an implementation of the invention, and is not intended to limit the invention to any specific embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
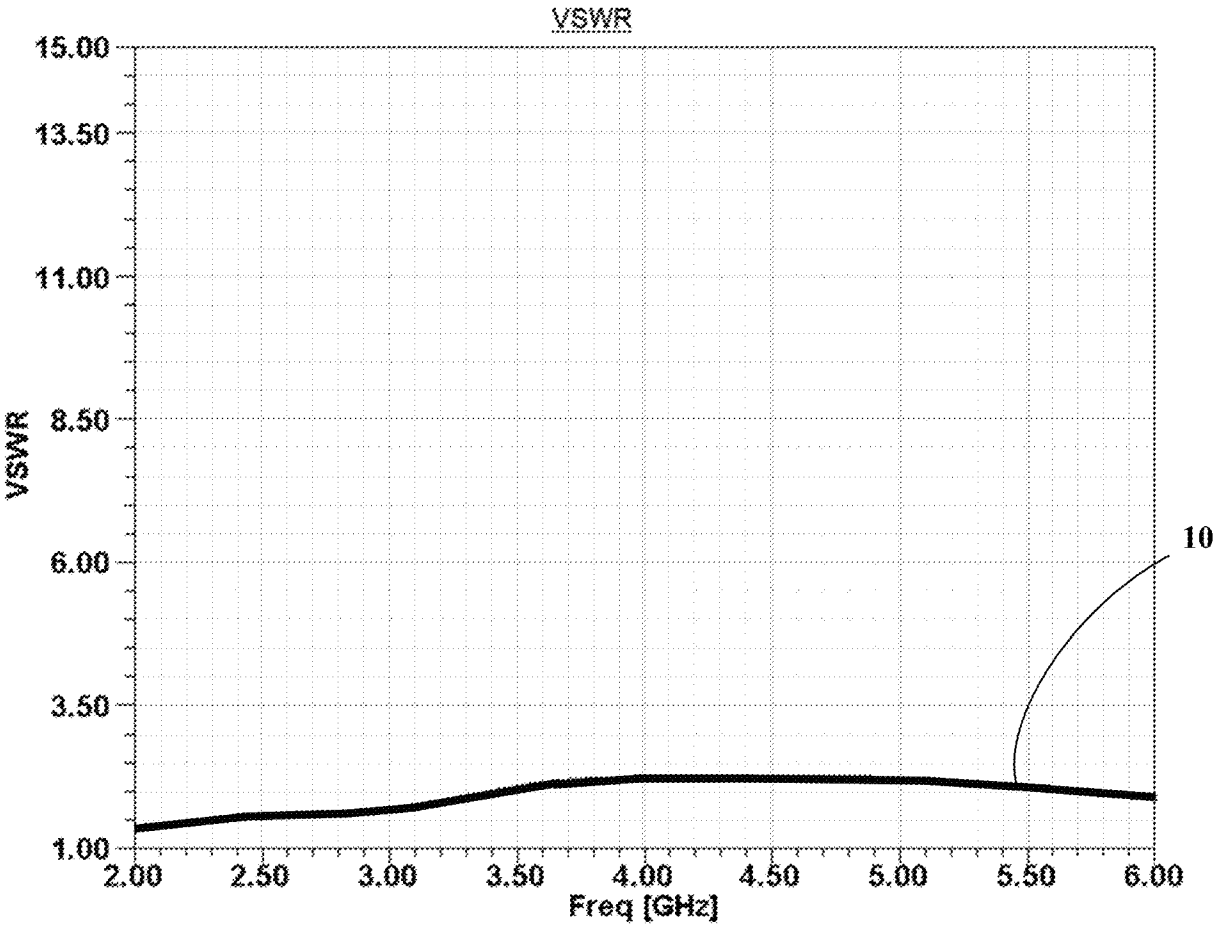
FIG. 1 shows a graph of VSWR, as a function of frequency, of an antenna element.
Figure 2B:
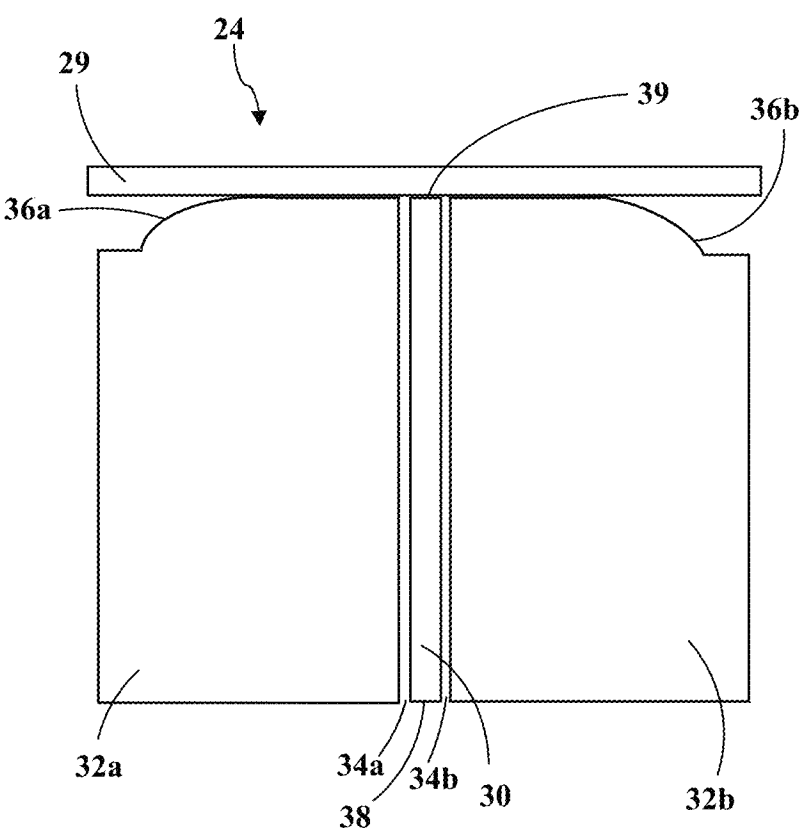
FIGS. 2A and 2B show various aspects of an antenna element.
Figure 2A:
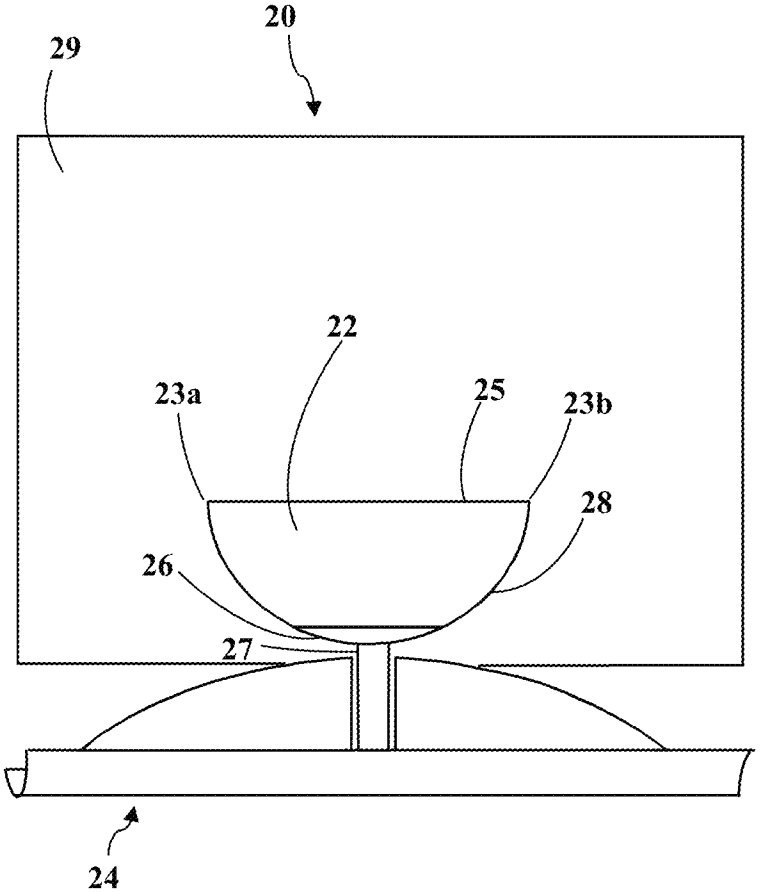

FIG. 1 shows a graph of Voltage Standing Wave Ratio (VSWR), as a function of frequency, for a typical wideband antenna element, calculated by a well-known and commercially available electromagnetic software (Ansys-HFSS), corresponding to the configuration shown in FIGS. 2A and 2B. Referring to FIG. 1, curve 10 shows the voltage ratio between the maximum of the standing voltage to the minimum of the standing voltage on a transmission line feeding the antenna. Those skilled in the art will recognize that a good antenna has a VSWR value not larger than 2.5. The results of the VSWR values of curve 10 are lower than 2.5 over the 2 to 6 GHz frequency band, which is an indication of a good antenna performance in this frequency range. This is indicative that the frequency band of operation of the referred typical wideband antenna element includes the range from 2 to 6 GHz.

FIGS. 2A and 2B show various aspects of an antenna element 20. In particular, FIG. 2A shows an exemplary configuration of an antenna element 20, comprising a planar antenna section 22, a transmission line, implemented in this case by a coplanar waveguide 24, and a feeding coupling element 26. Antenna section 22 comprises a resistive layer, consisting of an Indium tin oxide-based film with a sheet resistivity of approximately 50 Ohms per square. The configuration of antenna section 22 has a semi-elliptical configuration, comprising a first edge 25, primarily having a linear shape, and a second edge 28, having an elliptical shape. Second edge 28 is elliptically shaped according to an ellipse with a major axis of 26.4 mm, substantially parallel to first edge 25, and a major-to-minor axes ratio of 1.1. Accordingly, first edge 25 and second edge 28 join at two regions defining corners 23*a* and 23*b* of antenna element 22.

Feeding coupling element 26 is made of a conductive material and has a semi-elliptical configuration shaped according to the configuration of antenna section 22, with a minor axis ratio of approximately 3 mm. An area within the peripheral boundary defined by antenna section 22 fully overlaps with an area within the peripheral boundary defined by feeding coupling element 26. In general, the area defined by feeding coupling element 26 is smaller than the area defined by antenna section 22, such that an edge of feeding coupling element 26 follows second edge 28 of antenna section 22.

In the configuration shown in FIG. 2A, coplanar waveguide 24 is electrically connected to feeding coupling element 26 by a rectangular section 27, made of conductive material, of approximately 3-mm width and 2-mm length. Antenna section 22, feeding coupling element 26, and rectangular section 27 are disposed on top of a glass substrate 29 having approximate dimensions of 60×44 mm and 0.7-mm thickness, a relative permittivity of 7 and a loss tangent of 0.01. Rectangular section 27, extends from feeding coupling element 26 on glass substrate 29.

Feeding coupling element 26 physically and electrically couples with antenna section 22. Antenna section 22 attaches to feeding coupling element 26 over the overlapping region by means of a conductive adhesive. Alternatively, feeding coupling element 26 may electromagnetically couple, i.e., connect capacitively or inductively, to antenna section 22. Furthermore, feeding coupling element 26 may attach to antenna section 22 by means of soldering or any other conductive material.

Likewise, FIG. 2B shows an exemplary configuration of coplanar waveguide 24, formed by thin layers of conductive material disposed on a rigid or flexible substrate (not shown), as well known to those skilled in the art. In particular, coplanar waveguide 24 is implemented by means of a thin layer of conductive feed line 30 and a ground plane structure formed by two thin layers of approximately 28.35-mm width and 43-mm length rectangular sections made of conductive material, 32*a* and 32*b*, disposed on each side of feed line 30 at a distance of about 0.15 mm from feed line 30 to define gaps 34*a* and 34*b* of coplanar waveguide 24. Rectangular sections 32*a* and 32*b* are placed at approximately 9.4 mm from glass substrate 29.

In this particular configuration, at about 4.1 mm from each edge of ground plane rectangular sections 32*a* and 32*b* opposite gaps 34*a* and 34*b*, and within the periphery of rectangular sections 32*a* and 32*b*, a thin layer of conductive material forming a smooth, concave, curved sections 36*a* and 36*b* start protruding outwards from the periphery of rectangular sections 32*a* and 32*b* and towards feed line 30 until it reaches a distance of 0.15 mm from the feed line section. In other words, curved sections 36*a* and 36*b* of coplanar waveguide 24 in combination with feed line 30 extend gaps 34*a* and 34*b* beyond the periphery of rectangular sections 32*a* and 32*b*. The length the curved edge of each of curved sections 36*a* and 36*b* is about 27.34 mm. The shape and dimensions of curved sections 36*a* and 36*b* are designed to provide a proper frequency response and impedance matching of antenna element 20.

Conductive feed line 30 has a rectangular shape, having a width of approximately 3 mm and a length of about 52.6 mm. A first end 38 of conductive feed line 30, opposite antenna section 22, is typically electrically connected, directly or indirectly, to a receiver (not shown) or a transmitter (not shown). A second end 39 of conductive feed line 30, proximate to antenna element 22, extends to form rectangular section 27 that connects to feeding coupling element 26. Ground plane sections 32*a* and 32*b* are disposed coplanar with and generally parallel to feed line 30 of coplanar waveguide 24.

Curved sections 36*a* and 36*b* are identical in dimensions and mirror images along an imaginary line, equidistant from gaps 34*a* and 34*b*, going from first end 38 to second end 39 of conductive feed line 30. Likewise, rectangular sections 32*a* and 32*b* are identical in dimensions. In this configuration, antenna element 20 is designed to operate at a frequency band that includes a first intended frequency band of operation, ranging approximately between 2.2 GHz and 2.5 GHz, and a second intended frequency band of operation, ranging approximately between 5 GHz and 5.8 GHz. The VSWR results, as a function of frequency, of antenna element 20 correspond to those shown in FIG. 1.

Those skilled in the art will recognize that antenna section 22 and coplanar waveguide 24 may be disposed coplanar or non-coplanar either on the same or different rigid or flexible substrates. Similarly, ground plane sections 32*a* and 32*b* as well as curved sections 36*a* and 36*b* of coplanar waveguide 24 may have different shapes and dimensions with respect to each other. Also, antenna section 22 may take on a geometrical configuration other than semi-elliptical. Correspondingly, feeding coupling element 26 may be configured to adapt to the configuration of antenna section 22.

Figure 3:
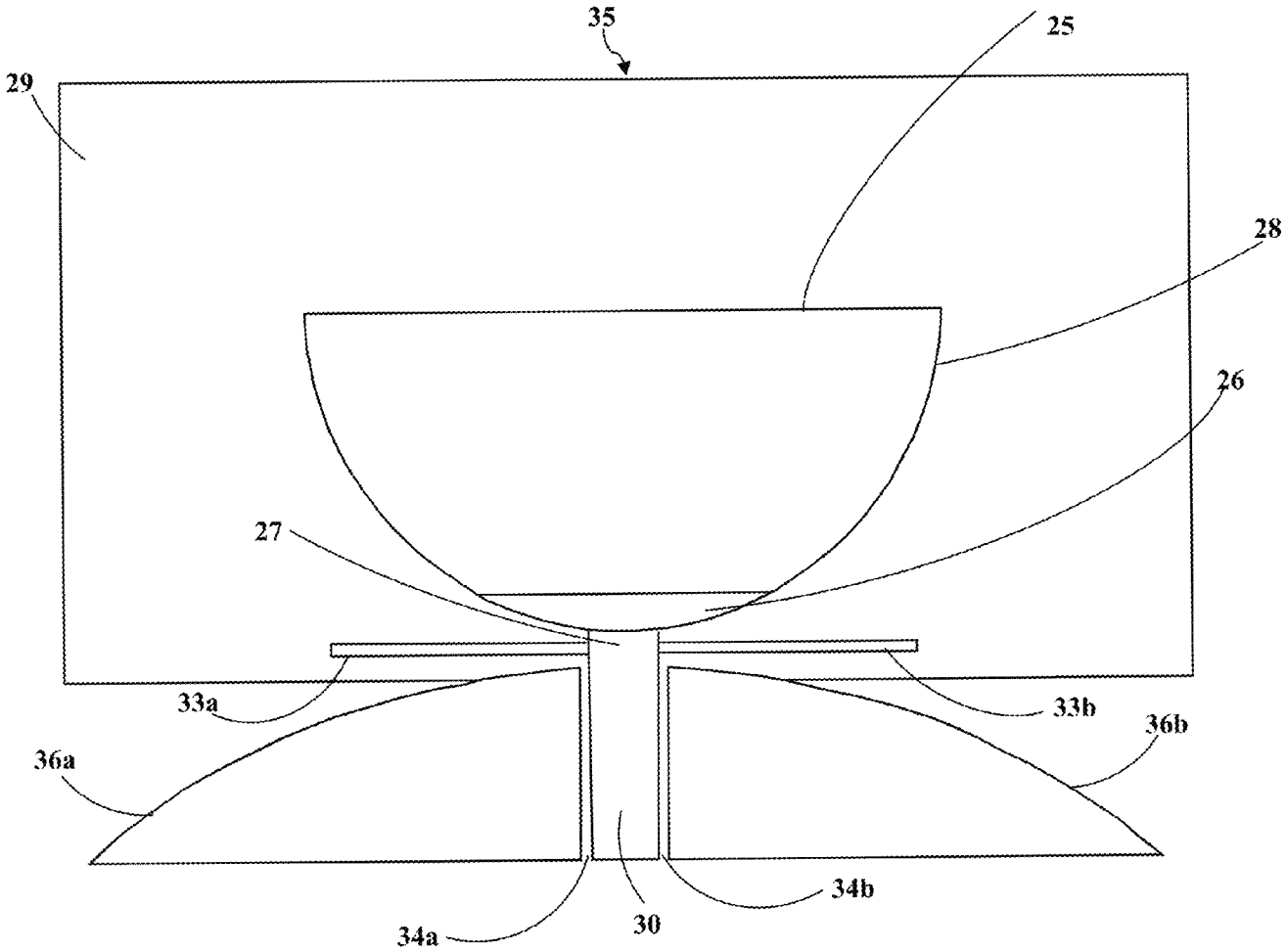
FIG. 3 shows a desensitized antenna system comprising an antenna element and a desensitizer element.

FIG. 3 show of an exemplary configuration of a desensitized antenna system 35, in accordance with aspects of an embodiment of the invention, comprising antenna element 20 and a desensitizer element further comprising a first section 33*a* and a second section 33*b*. In this particular configuration, first section 33*a* and second section 33*b* are identical in shape and dimensions and implemented by means of a thin conductive layer of material disposed on glass substrate 29. Each of the sections 33*a* and 33*b* are rectangular in shape having approximate dimensions of 11 mm in length and 0.3 mm in width. In addition, sections 33*a* and 33*b* are substantially perpendicular to feed line 30 of coplanar waveguide 24 and substantially parallel to first edge 25 of antenna section 22.

At one end, each of the sections 33*a* and 33*b* physically and electrically couple to section 27 of feed line 30 of coplanar waveguide 24. In this particular configuration, sections 33*a* and 33*b* are disposed approximately 0.93 mm from curved sections 36*a* and 36*b*, respectively. As a result, sections 33*a* and 33*b* are separated approximately 0.77 mm from feeding coupling element 26. Accordingly, in practice, sections 33*a* and 33*b* effectively become a part of coplanar waveguide 24. Typically, sections 33*a* and 33*b* are included in the design of coplanar waveguide 24 such that the manufacturing of coplanar waveguide 24 includes sections 33*a* and 33*b*, As such, sections 33*a* and 33*b* may be considered lateral extensions of section 27 of feed line 30 that allow adjusting the overall frequency response of desensitized antenna system 35.

Alternatively, those skilled in the art will realize that the desensitizer element of desensitized antenna system 35 may be implemented as part of coplanar waveguide 24 by other means, including one or a combination of more than one extensions of section 27 having different lengths, widths, locations, and orientations with respect to feed line 30, and slits cut out from ground plane sections 32*a* and 32*b* having different lengths, widths, locations, and orientations with respect to feed line 30. Furthermore, additional sections of coplanar waveguide 24 may be inserted at either end of section 27 of feed line 30 to implement sections 33*a* and 33*b*.

Those skilled in the art will also realize that sections 33*a* and 33*b* may couple to section 27 of feed line 30 by means of a conductive adhesive, soldering or any other conductive material, or electromagnetic coupling, i.e., connected capacitively or inductively.

Figure 4:
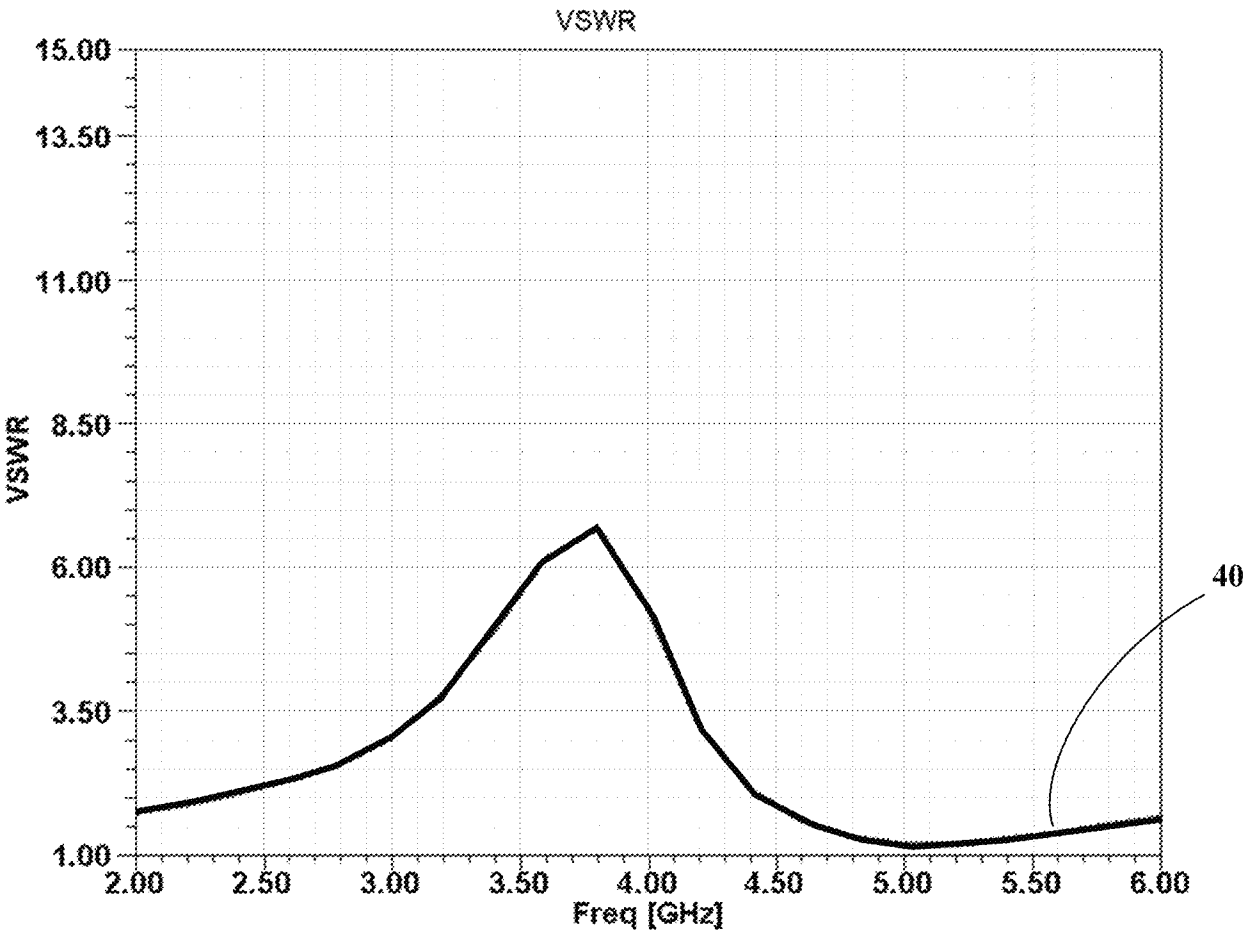
FIG. 4 shows a graph of VSWR, as a function of frequency, of a desensitized antenna system comprising an antenna element and a desensitizer element.

FIG. 4 shows a graph of VSWR, as a function of frequency, for desensitized antenna system 35, calculated by a well-known and commercially available electromagnetic software (Ansys-HFSS). Referring to FIG. 4, curve 40 indicates that desensitized antenna system 35 has a good antenna performance over the 2 to 2.7 GHz and the 4.35 to 6 GHz frequency bands. In other words, desensitized antenna system 35 does not have a good antenna performance in the 2.7 to 4.35 GHz frequency range. These results show that the integration of desensitizer elements 33*a* and 33*b* with antenna element 20 significantly mitigate the transmission and reception of RF signals by desensitized antenna system 35. In other words, undesired noise, signal interference, or electromagnetic coupling effects that may affect or be induced by the antenna element 20 are significantly reduced or practically eliminated by desensitized antenna system 35.

In addition, desensitized antenna system 35 still operates at the first intended frequency band of operation, ranging approximately between 2.2 GHz and 2.5 GHz, and the second intended frequency band of operation, ranging approximately between 5 GHz and 5.8 GHz. Moreover, desensitized antenna system 35 can be detuned up or down in frequency by 200 MHz in the first intended frequency band of operation and by at least 200 MHz in the second intended frequency band of operation and still maintain a good performance operation for the intended frequency bands of operation. Likewise, desensitized antenna system 35 can be detuned up in frequency up to 650 MHz in the second frequency band of operation maintaining a VSWR value not larger than 2.5, which means a good antenna performance.

In practice, sections 33*a* and 33*b* act like a band-stop or band-reject RF frequency filtering element. Referring to FIG. 4, the overall frequency band of desensitized antenna system 35 is substantially reduced from 2 to 6 GHz, corresponding to antenna element 20 as shown in FIG. 1, to about 2 to 2.7 GHz and 4.35 to 6 GHz, as shown in FIG. 4 (corresponding to VSWR values not larger than 2.5). In other words, the combination of antenna element 20 and desensitizer sections 33*a* and 33*b* converts the wideband antenna element 20 into a dual-band desensitized antenna system, within the 2 to 6 GHz frequency band of the wideband antenna element, significantly lessening interference and noise consequences while still retaining the desensitized nature of the wideband antenna element at the frequencies of interest. Accordingly, said antenna system can overcome detuning and offsets in frequency by means of the desensitized wideband antenna element operating in the 2 to 6 GHz frequency band, while the overall noise and interference effects are significantly mitigated, at least in a significant region of 2.7 to 4.35 GHz, by effectively having a dual-band antenna system operating in the 2 to 2.7 GHz and 4.35 to 6 GHz frequency bands.

In certain applications, the location of antenna section 22 on an electronic device, such as a touchscreen, is strictly limited to a small area on a given layer of such device. The use of a flexible structure such as a flexible printed circuit (FPC) offers an option to reduce the overall size occupied by antenna element 20 on the space-limited layer of the electronic device. Those skilled in the art will realize that a coplanar waveguide may be implemented on a flexible substrate, such as polyimide.

Alternatively, antenna element 20 or desensitizer sections 33*a* and 33*b* can also be implemented on a flexible substrate such that the entire desensitized antenna system 35 is disposed on a flexible substrate. This may be advantageous for certain applications in terms of antenna performance or a practical, low cost implementation. Furthermore, a desensitizer element may be implemented by means of one or a combination of more than one passive or active devices, including various types of RF filters (e.g., low-pass, high-pass, band-pass, and band-stop filters), amplifiers, impedance matching networks, couplers, capacitors, inductors, diodes, and transistors disposed on a rigid or flexible substrate.

Those skilled in the art will also realize that other methods of implementing feed line 30 are possible. Thus, in addition to using a coplanar waveguide, a microstrip line, a coplanar stripline, a coaxial cable and its associated transition sections to planar structures, a slot, and other types of transmission lines known in the prior art, may be used without departing from the spirit and scope of the invention.

Furthermore, in any of the configurations described herein, the antenna element or the desensitized antenna system may operate in an elliptical polarization, including a generally linear polarization and a generally circular polarization; in a single frequency band or multiple frequency bands; and as part of a single, diversity, multiple input multiple output (MIMO), reconfigurable or beam forming network system.

Likewise, those skilled in the art will realize that one or more components described in the different configurations of the desensitized antenna system may be conformal to a structural platform in which the component is located and or disposed on or embedded in a dielectric material. Furthermore, at least one antenna element may be disposed on a laptop computer, tablet, cellphone, touch-screen display devices, or other handheld device. Moreover, any component of the desensitized antenna system may be implemented by means of a resistive film comprising a metal oxide compound, such as tin oxide, disposed on a flexible or rigid substrate, or by application of a resistive coating directly to a flexible or rigid substrate or to a thin layer of a substrate such as polyethylene terephthalate or polyimide to be disposed on a flexible or rigid substrate.

Figure 5:
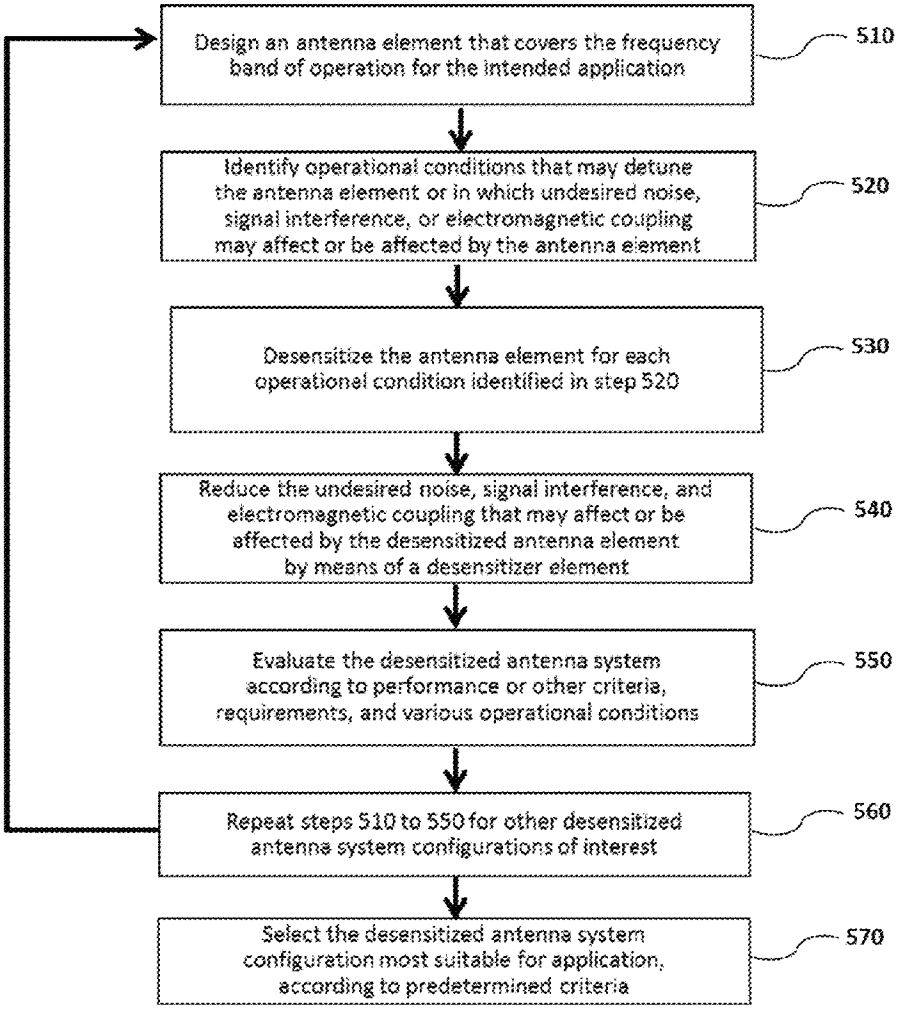
FIG. 5 shows a schematic view of a method for designing a desensitized antenna system.

Regarding each of the above-described configurations, a method as depicted in FIG. 5 for designing a desensitized antenna system to mitigate adverse effects when operating in a potentially antenna-detuning environment or under conditions that may interfere with other systems or be susceptible to interference from other sources, and for setting up the antenna system dimensional and operational parameters, may be performed according to the following:

1. At step 510, designing an antenna element having an operational frequency range that includes a minimum required system frequency band of operation, corresponding to an intended application (e.g., one or more Wi-Fi frequency bands on a handheld device).

2. Next, at step 520, identifying the operational conditions in which the frequency response of the antenna element may be uniquely or significantly detuned or offset or in which undesired noise, signal interference, or electromagnetic coupling effects may affect or be induced by the antenna element. These operational conditions may include the presence of any combination of user body parts (e.g., hands, fingers, head or other parts of the body as when such device is placed in a pocket or hung on clothing), conductive materials, or dielectric materials located within a radius of two wavelengths at the lowest frequency of operation in the medium where the antenna element is operating as well as neighboring electronic systems or other sources of undesired noise, signal interference, and electromagnetic coupling.

3. Next, at step 530, desensitizing the antenna element, for each operational condition identified in step 520, by implementing one or more of the following approaches:

3.1 Designing a wideband antenna element such that the resulting operational frequency range of the antenna element includes the minimum required system frequency band of operation with and without the effects of the corresponding frequency detuning or offset condition.

3.2 Designing a "detuned" or "offset" antenna element such that the resulting operational frequency range of the antenna element, under the corresponding frequency detuning or offset condition, includes the minimum required system frequency band of operation.

3.3 Extending the frequency bandwidth of the antenna element such that the resulting operational frequency range of the antenna element, under the corresponding frequency detuning or offset condition, includes the minimum required system frequency band of operation.

3.4 Improving key performance parameters of the antenna element (e.g., gain, efficiency, radiation pattern, polarization, input impedance, etc.), based on a statistical distribution of theoretical and/or experimental data corresponding to different operational conditions, to compensate for the perturbing effects caused by these conditions.

3.5 Improving key performance parameters of the antenna element (e.g., gain, efficiency, radiation pattern, polarization, input impedance, etc.) to have a larger frequency bandwidth response, such that the resulting operational frequency range of one or more of these key performance parameters, under the corresponding frequency detuning or offset condition, includes the minimum required system frequency band of operation.

4. Next, at step 540, reducing the undesired noise, signal interference, or electromagnetic coupling effects that may affect or be induced by the desensitized antenna element, by designing a desensitized antenna system comprising at least one desensitized antenna element, including an antenna element resulting from the approaches described in step 530, and at least one desensitizer element comprising at least one electrical circuit component (e.g., filter, coupler, amplifier, passive network, etc.), such that the overall frequency bandwidth of the antenna system becomes narrower than the frequency bandwidth of the antenna element.

5. Next, at step 550, evaluating the operation of the desensitized antenna system, according to performance or other criteria, requirements, and various operational conditions.

6. Next, at step 560, repeating steps 510 to 550, if necessary, for other configurations of the desensitized antenna system.

7. Last, at step 570, selecting the most suitable configuration of the desensitized antenna system (dimensional and operational parameters of the antenna element and other components of the antenna system) for the intended application, in terms of performance or other predetermined criteria.

Those of ordinary skill in the art will recognize that the steps above indicated can be correspondingly adjusted for specific configurations and other constraints, including operating frequency band and bandwidth, radiation gain, polarization, radiation efficiency, input impedance matching, operational conditions, surrounding environment, available area and location for implementation of the antenna system components, type and number of electrical circuit elements, method of antenna feeding, and type of transmission line used for a given application.

Preferably, the determination of the dimensional and operational parameters of the antenna element and other components of the desensitized antenna system, and the evaluation of the desensitized antenna system performance parameters, including but not limited to electromagnetic fields, radiation efficiency, currents, radiation gain, input impedance, and polarization are performed by means of a computer-assisted simulation tool and electromagnetic simulation software, such as Ansys-HFSS commercial software or other methods well-known by those skilled in the art.

Most preferably, a data processing and decision making algorithm may be implemented to analyze antenna parameters or calculate a figure of merit of the antenna system performance, including but not limited to electromagnetic fields, radiation efficiency, currents, radiation gain, input impedance, and polarization, to support or guide the desensitized antenna system design process as described herein, as those skilled in the art will realize.

The method and various embodiments have been described herein in an illustrative manner, and it is to be understood that the terminology used is intended to be in the nature of words of description rather than of limitation. Any embodiment herein disclosed may include one or more aspects of the other embodiments. The exemplary embodiments were described to explain some of the principles of the present invention so that others skilled in the art may practice the invention. Obviously, many modifications and variations of the invention are possible in light of the above teachings. The present invention may be practiced otherwise than as specifically described within the scope of the appended claims and their legal equivalents.

We claim:

1. An antenna system, comprising:

an antenna element;

a desensitizer element coupled to said antenna element; and a transmission line coupled to said desensitizer element;

wherein said antenna element has a first frequency band of operation including a second frequency band of operation for an intended application of said antenna element, such that a frequency detuning of said antenna element, caused by an operational condition of said antenna element, will maintain said antenna element operable within said second frequency band of operation of said intended application; wherein said desensitizer element has at least a third frequency band of operation narrower than said first frequency band of operation of said antenna element, such that said antenna system operates at a fourth frequency band of operation that is at least as wide as said second frequency band of operation of said intended application but narrower than said first frequency band of operation of said antenna element; and wherein said desensitizer element is configured such that an input impedance at said desensitizer element substantially matches an input impedance of said transmission line coupled to said desensitizer element.

2. The antenna system of claim 1, wherein said antenna element comprises a resistive layer comprising a metal compound such that said resistive layer is partly electrically conductive.

3. The antenna system of claim 1, wherein said second frequency band of operation comprises a plurality of frequency bands of operation smaller than said second frequency band of operation for a plurality of applications.

4. The antenna system of claim 1, wherein said antenna system operates at a plurality of frequency bands of operation.

5. The antenna system of claim 1, further comprising a substantially non-conductive substrate, wherein at least one element of said antenna system is at least partly mounted on said substrate.

6. The antenna system of claim 5, wherein at least one element of said antenna system is at least partly conformal to said substrate.

7. The antenna system of claim 5, wherein said substrate is part of a touchscreen.

8. The antenna system of claim 1, wherein said desensitizer element comprises at least one electronic component.

9. The antenna system of claim 8, wherein said at least one electronic component is a radiofrequency filter.

10. The antenna system of claim 8, wherein said at least one electronic component is a passive component.

11. The antenna system of claim 8, wherein said at least one electronic component is an active component.

12. The antenna system of claim 1, wherein said desensitizer element is implemented by means of at least a section of said transmission line.

13. The antenna system of claim 1, further comprising a feeding coupling element coupled to a section of said transmission line.

14. The antenna system of claim 1, further comprising a flexible printed circuit, wherein said desensitizer element is integrated with said flexible printed circuit.

15. The antenna system of claim 1, further comprising an impedance matching network.

16. The antenna system of claim 15, wherein said at least one edge has a shape according to an elliptical function.

17. A method for designing an antenna, comprising:

a. providing an antenna system comprising:

an antenna element;

a desensitizer element coupled to said antenna element; and a transmission line coupled to said desensitizer element;

wherein said antenna element has a first frequency band of operation including a second frequency band of operation for an intended application of said antenna element, such that a frequency detuning of said antenna element, caused by an operational condition of said antenna element, will maintain said antenna element operable within said second frequency band of operation of said intended application; wherein said desensitizer element has at least a third frequency band of operation narrower than said first frequency band of operation of said antenna element, such that said antenna system operates at a fourth frequency band of operation that is at least as wide as said second frequency band of operation of said intended application but narrower than said first frequency band of operation of said antenna element; and wherein said desensitizer element is configured such that an input impedance at said desensitizer element substantially matches an input impedance of said transmission line coupled to said desensitizer element;

b. determining an initial design of said antenna element, wherein an operational frequency range of said antenna element includes a minimum required system frequency band of operation, corresponding to said intended application;

c. identifying a number of operational conditions in which said frequency range of said antenna element may be uniquely or significantly detuned or in which undesired noise, signal interference, or electromagnetic coupling effects may affect or be induced by said antenna element;

d. desensitizing said antenna element, for each operational condition in which said frequency range of said antenna element may be uniquely or significantly detuned or in which undesired noise, signal interference, or electromagnetic coupling effects may affect or be induced by said antenna element; and e. selecting a most suitable configuration of said desensitized antenna system for said intended application, in terms of performance or other predetermined criteria.

18. The method of claim 17, wherein desensitizing said antenna element further comprises at least one of the following steps:

a. designing a wideband antenna element wherein said first frequency band of operation includes said second frequency band of operation for said intended application with and without said frequency detuning caused by said operational condition of said antenna element;

b. designing a detuned antenna element wherein a resulting operational frequency range of said detuned antenna element, under the corresponding frequency detuning condition, includes said second frequency band of operation for said intended application;

c. extending said frequency band of operation of said antenna element wherein a resulting operational frequency range of said antenna element, under the corresponding frequency detuning condition, includes said second frequency band of operation for said intended application;

d. improving key performance parameters of said antenna element, based on a statistical distribution of data corresponding to different operational conditions, to compensate for the perturbing effects caused by said operational conditions; and e. improving key performance parameters of said antenna element wherein a resulting operational frequency range of at least one of said key performance parameters, under the corresponding frequency detuning condition, includes said second frequency band of operation for said intended application.

19. The method of claim 17, further comprising the steps of reducing undesired effects that may affect or be induced by said antenna element by means of a desensitizer element, and evaluating an operation of said desensitized antenna system, according to performance or other criteria, requirements, and various operational conditions.

20. The method of claim 19, further comprising the step of using a computer-assisted tool to determine an antenna performance parameter used to select said most suitable desensitized antenna system.

* * * * *